US005682946A

United States Patent [19]

Schmidt et al.

[11] Patent Number: 5,682,946

[45] Date of Patent: Nov. 4, 1997

[54] TUBE FOR USE IN A HEAT EXCHANGER

[75] Inventors: Martin Schmidt, Fröndenberg; Ulrich Naumann, Menden, both of Germany

[73] Assignee: KM Europa Metal Aktiengesellschaft, Osnabrück, Germany

[21] Appl. No.: 617,466

[22] Filed: Mar. 18, 1996

[30] Foreign Application Priority Data

Mar. 21, 1995 [DE] Germany ..... 195 10 124.3

[51] Int. Cl.[6] ..... F28F 1/40

[52] U.S. Cl. ..... 165/133; 165/DIG. 515; 165/184

[58] Field of Search ..... 165/133, 184, 165/DIG. 515; 62/527; 29/890.049

[56] References Cited

U.S. PATENT DOCUMENTS

| | | | |
|---|---|---|---|
| 3,825,064 | 7/1974 | Inoue | 165/179 |
| 3,885,622 | 5/1975 | McLain | 165/179 |
| 4,216,826 | 8/1980 | Fujikake | 165/133 |
| 4,245,695 | 1/1981 | Fujikake | 165/133 |
| 4,819,719 | 4/1989 | Grote et al. | 165/133 |
| 5,332,034 | 7/1994 | Chiang et al. . | |

FOREIGN PATENT DOCUMENTS

| | | | |
|---|---|---|---|
| 3010450 | 9/1981 | Germany | 165/133 |
| 54-65865 | 5/1979 | Japan | 165/133 |
| 57-58092 | 4/1982 | Japan | 165/133 |
| 63-61896 | 3/1988 | Japan | 165/133 |

*Primary Examiner*—Allen J. Flanigan
*Attorney, Agent, or Firm*—Kenyon & Kenyon

[57] ABSTRACT

A heat exchanger tube having a smooth outer surface and a textured inner surface. The inner surface is composed of parallel ribs which run at an angle deviating from 90° relative to the longitudinal axis of the exchanger tube. The ribs further have inclined flanks, channels delimited on the sides by the ribs, and depressions formed in the ribs, which may run crosswise at a distance from the bottom of the channels. The depressions are formed so as to follow a sine-shaped progression, in longitudinal cross-section of the ribs, which are provided with a surface micro-roughness and which are rounded on the top. The center longitudinal planes of the depressions are arranged at an angle deviating from 90° relative to the longitudinal axis of the exchanger tube. The opposite flanks of adjacent ribs are connected by means of rounded channel bottoms. The micro-roughness of the rib surfaces is produced by corundum blasting or laser beams.

27 Claims, 5 Drawing Sheets

FIG. 1
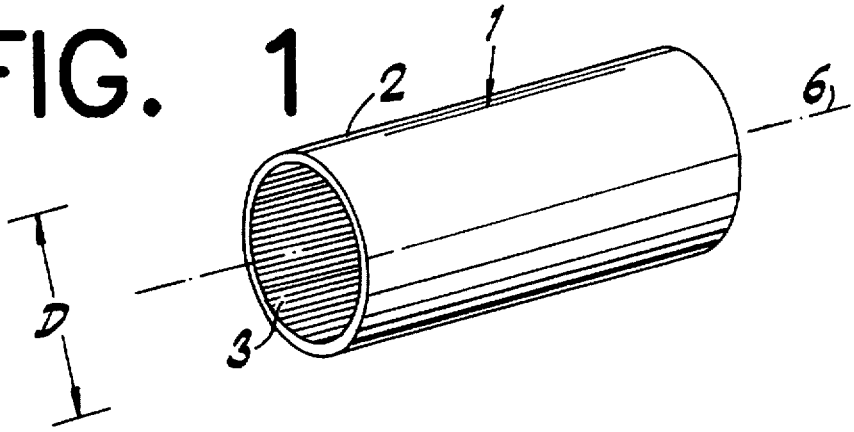
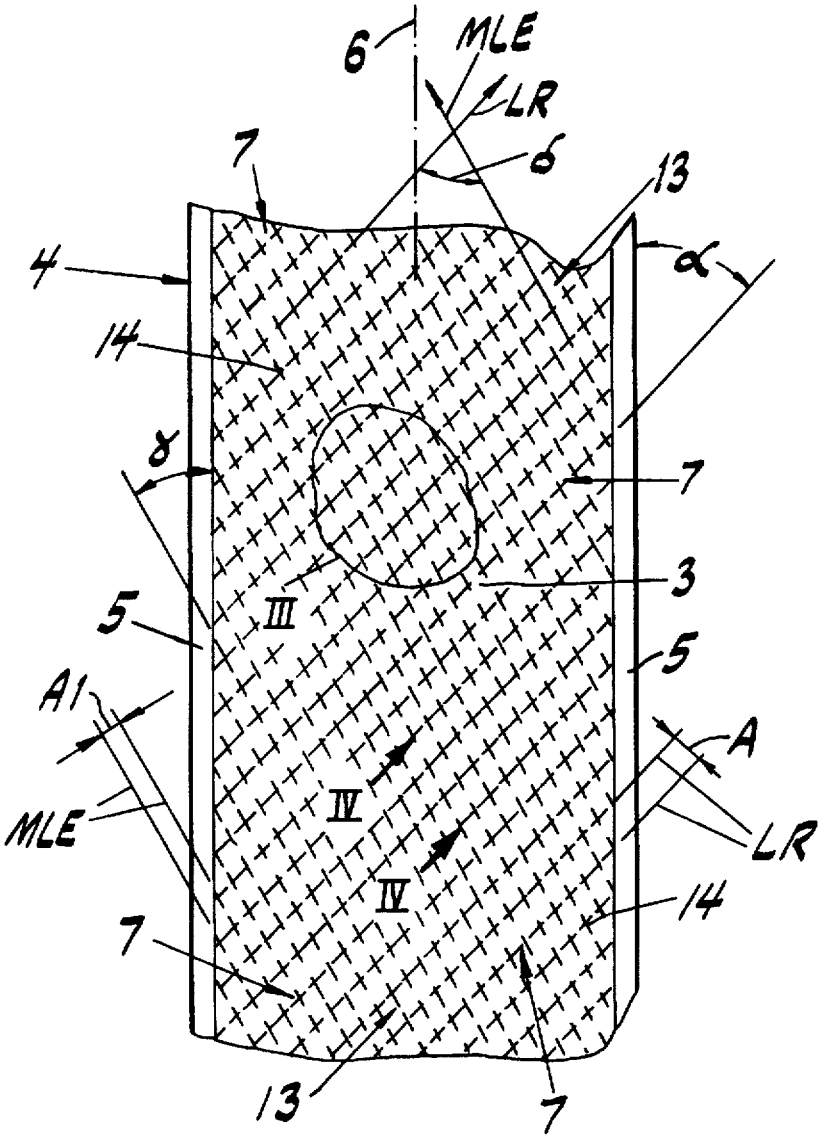
FIG. 2

TUBE FOR USE IN A HEAT EXCHANGER

BACKGROUND OF THE INVENTION

This invention relates generally to a tube for use in a heat exchanger. More particularly, it relates to a heat exchanger tube of the type having a smooth outer surface and an inner surface having textured ribs that extend at an angle with respect to the longitudinal axis of the tube. These ribs have both inclined flanks and periodically spaced depressions.

This general type of heat exchanger tube is described in U.S. Pat. No. 5,332,034 (the contents of which are incorporated herein by reference). Here, both the ribs and the channels delimited on the sides by the ribs have a trapezoidal cross-sectional shape. The cross-sectional volume of the ribs is dimensioned to be about half as great as the cross-sectional volume of the channels.

The depressions formed in the ribs are produced by rolling, which causes the material deformed out of the ribs to project into the channels frontally. The bottoms of the depressions are at a distance from the channel bottoms.

In the production of such a known type of heat exchanger tube, a surface of a metal strip is textured in a two-stage rolling process. The metal strip is then formed to produce a slit tube with an interior surface texture, and the slit edges are then welded together.

Several roller embossing tools are necessary for the production of such tubes, which compromises the economy with which they may be manufactured. The depressions of the ribs are formed by over-rolling a portion of the volume of the ribs embossed during the first rolling step. This former volume portion of the ribs is now distributed into the immediate vicinity. Such two-stage rolling of the interior surface texture requires a high level of production effort. Moreover, it is not possible to achieve any significant reduction in weight per meter of the tube by this known process.

Furthermore, because of the flatness of the head and flank sides of the ribs, condensate films (which are difficult to break and which retard condensation) can arise during use, thereby forming barrier layers having heat-insulating properties. Consequently, few edges are available for evaporation as vapor bubble sources.

There remains a need for an exchanger tube with an inner surface texture that provides uniformly good evaporation and/or condensation performance, reduced rib weight, and that can be manufactured by a more economical single-step embossing method.

SUMMARY OF THE INVENTION

The present invention meets this need. A tube is provided having a smooth outer surface and a textured inner surface comprising parallel ribs that run at an angle with respect to the axis of the tube. These ribs have inclined flanks that define channels in the areas between adjacent ribs. In their longitudinal direction, the ribs have a sinusoidal form including depressions that collectively run crosswise, also at an angle with respect to the axis of the tube. The flanks, peaks, and depressions smoothly merge into one another via rounded portions, yet are textured with a micro-roughness as well. Hence, the tubes have no sharp edges. Consequently, the rough surface texture can be produced in a single step, i.e., by roller embossing, in a particularly advantageous manner. The necessary expenditure in manufacturing apparatus technology is therefore significantly reduced.

As noted, the surfaces of the ribs, down to the channel bottoms, are provided with a targeted degree of micro-roughness. This enhances the level of heat transfer between the fluid flowing in the exchanger tube and the rough surface structure. The advantages of this approach are especially apparent, particularly for the condensation and evaporation of coolants, when the exchanger tube is incorporated into a corresponding heat exchanger. The cross-sectional volume of the ribs is reduced in favor of increasing the number of ribs. This makes it possible to increase the heat-exchanging surface textured area and thereby improve the rate of heat transfer. This approach also enables the production of very slim ribs (and hence therefore narrow channels).

The ribs, which are rounded at the top, have the particular advantage that when drawing a heat exchanger tube into the baffles of a heat exchanger, particularly by means of widening using a tool which is moved through the exchanger tube, the head portions of the ribs are flattened only an insignificant amount. This minimal amount of flattening helps prevent the formation of thermally insulating condensate films, which are difficult to break down. The surface micro-roughness provides a large number of projections, edges, tips and pits that serve as bubble nucleation sites to facilitate evaporation. Hence, the invention provides a large rib surface area without requiring a correspondingly large amount of material.

The surfaces of the baffles can also be provided with a rough texture corresponding to the interior texture of the exchanger tubes and/or with micro-roughness, if needed.

The invention is particularly useful for exchanger tubes made of metal, and especially those made of copper or copper alloys. Such exchanger tubes can have a round or an oval cross-section, for example. Round exchanger tubes preferably have an outside diameter of about 6 mm to 20 mm.

In accordance with one embodiment of the invention, the center longitudinal planes of the depressions run parallel to one another, but are offset relative to one another in the longitudinal direction of the ribs. Alternatively, the center longitudinal planes of the depressions of adjacent ribs may be aligned with each other.

The micro-roughness of the rib surfaces can be provided in a number of different ways. For example, diffuse roughening by means of blasted corundum can be employed. Furthermore, notching of the rib surfaces in the form of line-shaped micro-grooves is possible. These micro-grooves then preferably extend parallel to one another. However, their longitudinal direction deviates from the longitudinal direction of the ribs. The micro-roughness can also be formed by micro-grooves which intersect in the shape of a cross, deviating from the longitudinal direction of the ribs. Alternatively, instead of continuous micro-grooves, point-shaped pits can also be provided. These can also be arranged in line shape or in cross shape at a distance from one another.

The production of the micro-roughness can be implemented in a number of ways. The micro-roughness of the rib surfaces may be produced by means of blasting with hard particles, such as corundum. Alternatively, it can also be produced by texturing using laser beams. It is also possible either to work on the starting material (i.e., the sheet metal strip) which has already been provided with a surface texture, or to provide an embossing roller itself with the desired negative micro-roughness. Another approach is to profile the embossing roller by means of spark erosion.

BRIEF DESCRIPTION OF THE DRAWINGS

For a more complete understanding of this invention, reference should now be made to the embodiments illustrated in greater detail in the accompanying drawings and described below. In the drawings:

FIG. 1 is a perspective view of a length of heat exchanger tube;

FIG. 2 is a top view of a lengthwise strip of textured sheet metal used to form the exchanger tube;

DETAILED DESCRIPTION OF THE INVENTION

Figure 3:
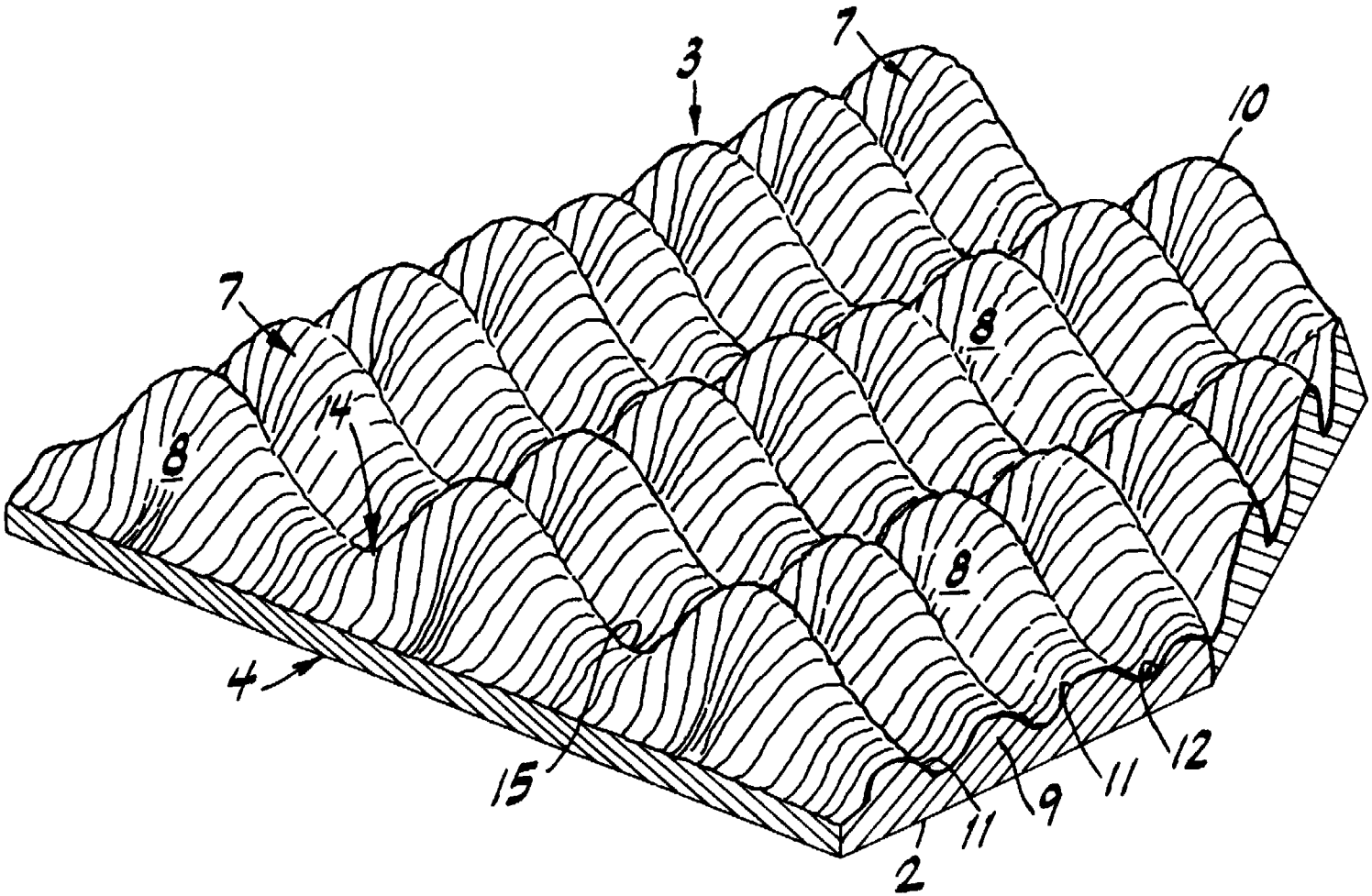
FIG. 3 is a magnified perspective view of region III of FIG. 2.

FIG. 1 illustrates a general embodiment of a lengthwise segment of an exchanger tube 1 formed with a longitudinal weld seam. The tube is used as part of a heat exchanger (not shown) for effecting the condensation and evaporation of coolants. In the embodiment shown, the exchanger tube 1 has an outside diameter D of 9.52 mm.

The exchanger tube may be circular or oval in cross-section. In the particular embodiment shown, the tube 1 has a circular cross-section inside and outside, a smooth outer surface 2, and a textured inner surface 3. The outer diameter of the tube (when circular) preferably lies within the range of about 6 mm to 20 mm; in the particular embodiment shown, the exchanger tube 1 has an outside diameter D of 9.52 mm.

In use, the tube will typically be set in place within the baffle of a heat exchanger, through which several tubes 1 arranged in parallel may pass. To fix the exchanger tube 1 in place, the exchanger tube 1 is introduced into an opening in the baffle that is adapted to fit the outside diameter of the tube, and fixed in place by widening the tube. A widening tool of appropriate shape is pushed through the exchanger tube 1 for this purpose.

The exchanger tube 1 is manufactured from a strip of copper (or copper alloy) sheet metal that is flat on both sides. The strip of sheet metal is subjected to a one-stage rolling process, which leaves smooth the side of the strip that is to become the outer surface 2 of the tube 1. The other side is provided with a textured surface, which subsequently forms the inner surface 3 of the heat exchanger tube 1. Only the border regions 5 of this side of the sheet metal strip 4 (which are subsequently joined together by welding) remain untextured (see FIG. 2). After roller-embossing, the sheet metal strip is formed into a slit tube, welded longitudinally, and then cut to length.

The texture of the inside surface 3 of the exchanger tube 1 will be explained in more detail below, with reference to FIGS. 2 through 5.

Figure 4:
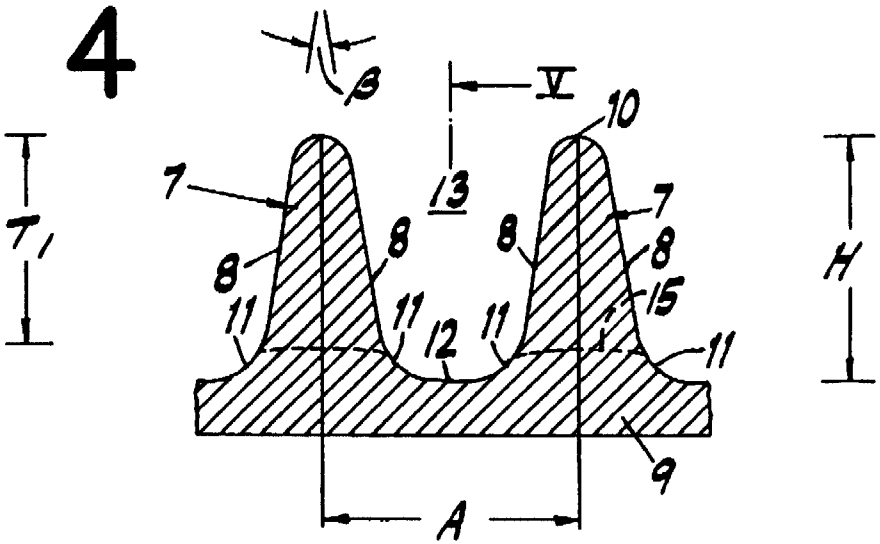
FIG. 4 is a magnified vertical cross-sectional view taken along the line IV—IV of FIG. 2.

The textured surface comprises parallel ribs 7 which run at an angle $\alpha$ of 45° relative to the longitudinal axis 6 of the exchanger tube 1 (see FIGS. 2 and 3). The ribs have inclined flanks 8 (FIGS. 3 and 4); the flank angle $\beta$ of the ribs 7 is 20° in the embodiment shown, the distance A between two adjacent ribs 7 is 0.35 mm (FIGS. 2 and 4); and their height H is 0.30 mm (FIG. 4). The base section 9, which connects the ribs in their foot region, has a thickness D1 of 0.30 mm (FIG. 5).

As is illustrated in FIGS. 3 and 4, both the head regions 10 of the ribs 7 and the transitions 11 of the flanks 8 that extend to the channel bottoms 12 are rounded. The cross-sectional volume of the ribs 7 is dimensioned to be less than the cross-sectional volume of the channels 13 that are located between the ribs 7.

Figure 5:
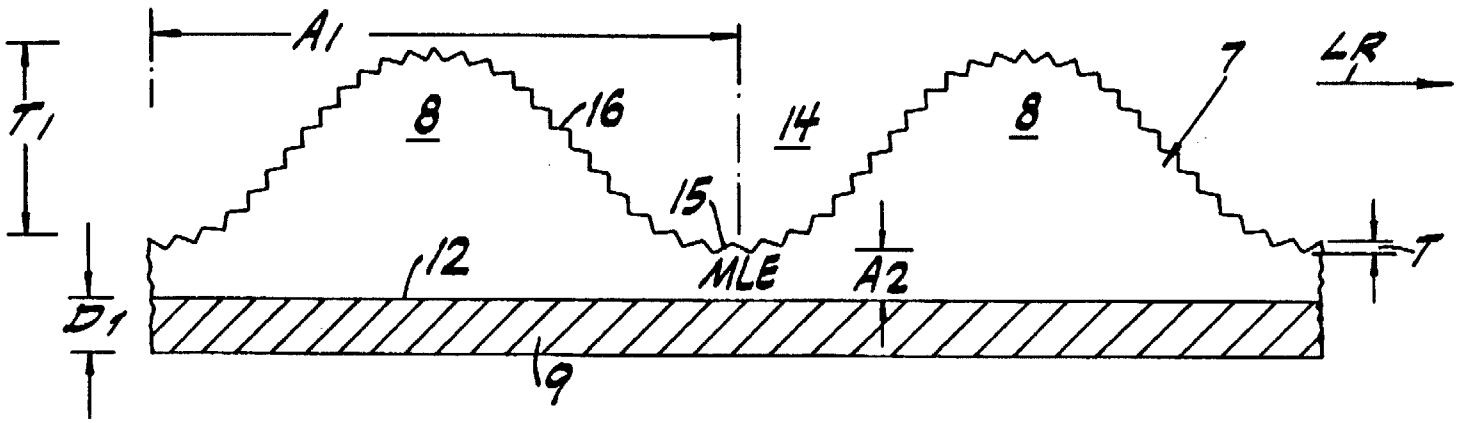
FIG. 5 is a vertical longitudinal cross-sectional view taken along the line V—V of FIG. 4, and FIGS. 6 and 7 provide a graphical comparison of performance among heat exchangers of coaxial design for various inner surface geometries.

As can particularly be seen in FIGS. 3 and 5, each rib 7 is provided with a sine-waved-shaped crest progression, seen in longitudinal cross-section, which extend longitudinally in the direction LR. Of course, in addition to having crests, these waves have depressions 14 in the ribs 7 as well. These depressions run crosswise. As shown in FIG. 2, depressions 14 of adjacent ribs 7 are arranged at an angle $\gamma$ of 45° relative to the longitudinal axis 6 of the exchanger tube 1, behind and aligned with each other. The angle $\delta$ enclosed between the longitudinal direction LR of the ribs 7 and the center longitudinal planes MLE of the depressions 14 is 90°. The distance A1 between two adjacent depressions 14 in the longitudinal direction of a rib 7 is 0.50 mm (FIGS. 2 and 5) and the distance A2 between the depression bottoms 15 and the channel bottoms 12 is 0.01 mm. The depressions 14 have a depth T1 of 0.25 mm (FIGS. 4 and 5).

FIG. 5 provides an exaggerated representation of the wave ridge of the ribs 7, including the surfaces 8, 10, and 11 of the ribs 7. The head regions 10, the flanks 8 and the transitions 11 from the flanks 8 to the channel bottoms 12, as well as the channel bottoms 12 (if necessary) are provided with a micro-roughness 16, the depth T of which is 0.005 mm.

The micro-roughness 16 is produced directly during roller-embossing in the illustrated embodiment. For this purpose, the embossing roller is provided with a negative diffuse surface texture, by means of corundum blasting, which assures production of the desired surface texture along what becomes the inner surface 3 of the exchanger tube 1.

The dimensions set forth in the foregoing discussion are of one preferred embodiment. More generally, studies have revealed that particularly good condensation and evaporation performance is achieved with a micro-roughness of depth 0.075 mm or less. While the flank angle of the ribs can range from 5° to 60°, the preferred range is from 10° to 40°. In this manner, it is possible to produce a very slim rib contour. Similarly, while the progression of the ribs relative to the longitudinal axis of the exchanger tube runs at an angle that can range from 1° to 89°, a range of 20° to 55° is preferred. The angle enclosed between the longitudinal direction of the ribs and the center longitudinal planes of the depressions is dimensioned to be 90° and less.

Similarly, studies have shown that the distance between two adjacent ribs should lie within the range of 0.10 mm to 2.0 mm, and preferably between 0.26 mm and 0.6 mm. The height of the ribs, depending on the tube diameter, is dimensioned to be 0.03 mm to 1.0 mm, and preferably between 0.05 mm and 0.35 mm. The distance between two adjacent depressions of a rib is 0.2 mm to 4.0 mm, and preferably 0.3 mm to 1.0 mm.

The bottoms of the depressions and the channel bottoms do not have to lie in a common plane, in which case the minimum distance between the depression bottoms and the channel bottoms should be 0.01 mm. However, it is also possible to arrange the depression bottoms and the channel bottoms in the same plane.

Because of the textured inner surface 3, the exchanger tube 1 illustrated in FIG. 1 has a significantly better heat transfer coefficient k' (W/mK), not only in comparison with an exchanger tube with a smooth surface, but also in comparison with an exchanger tube grooved on the inside.

Figure 6:
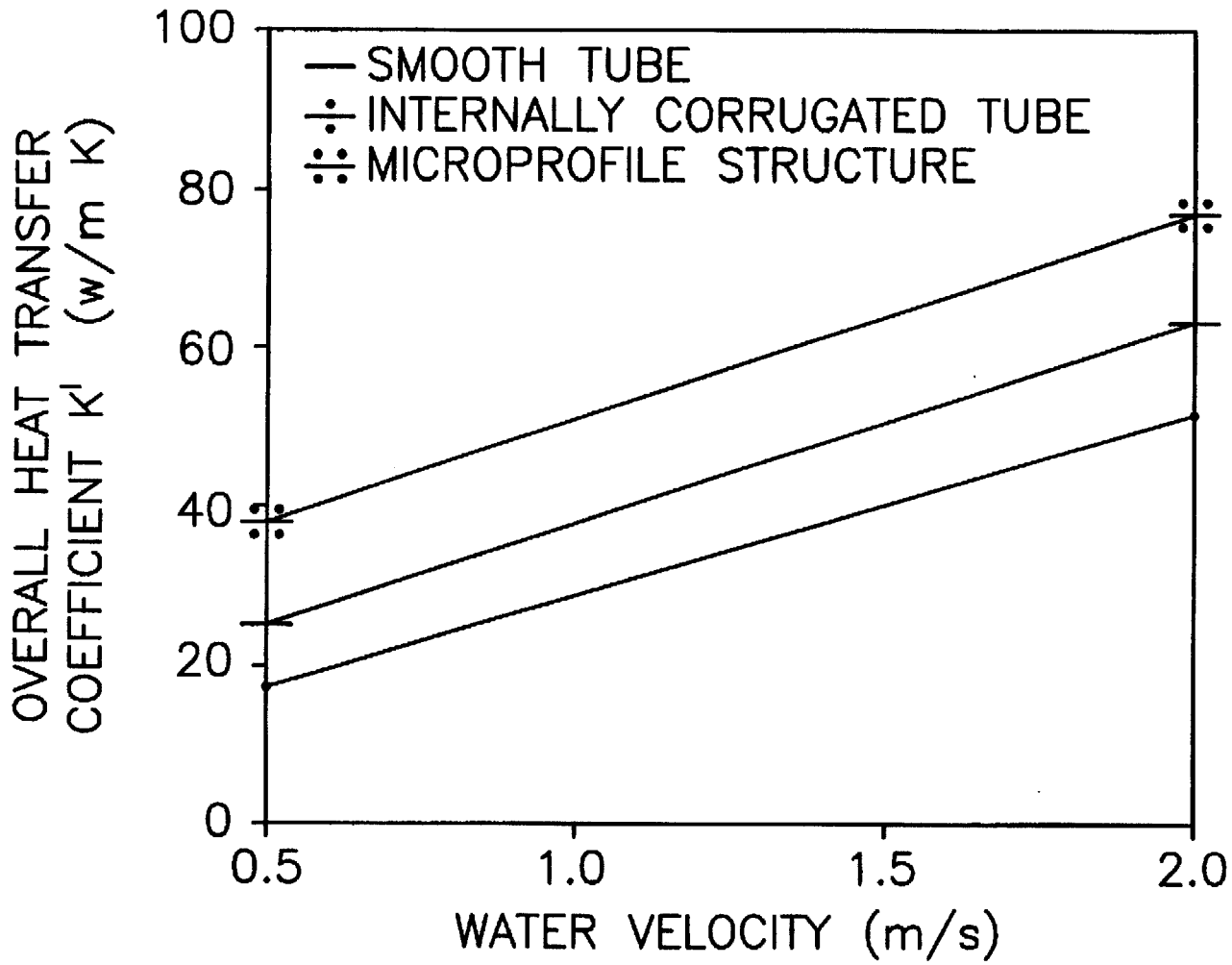
Figure 7:
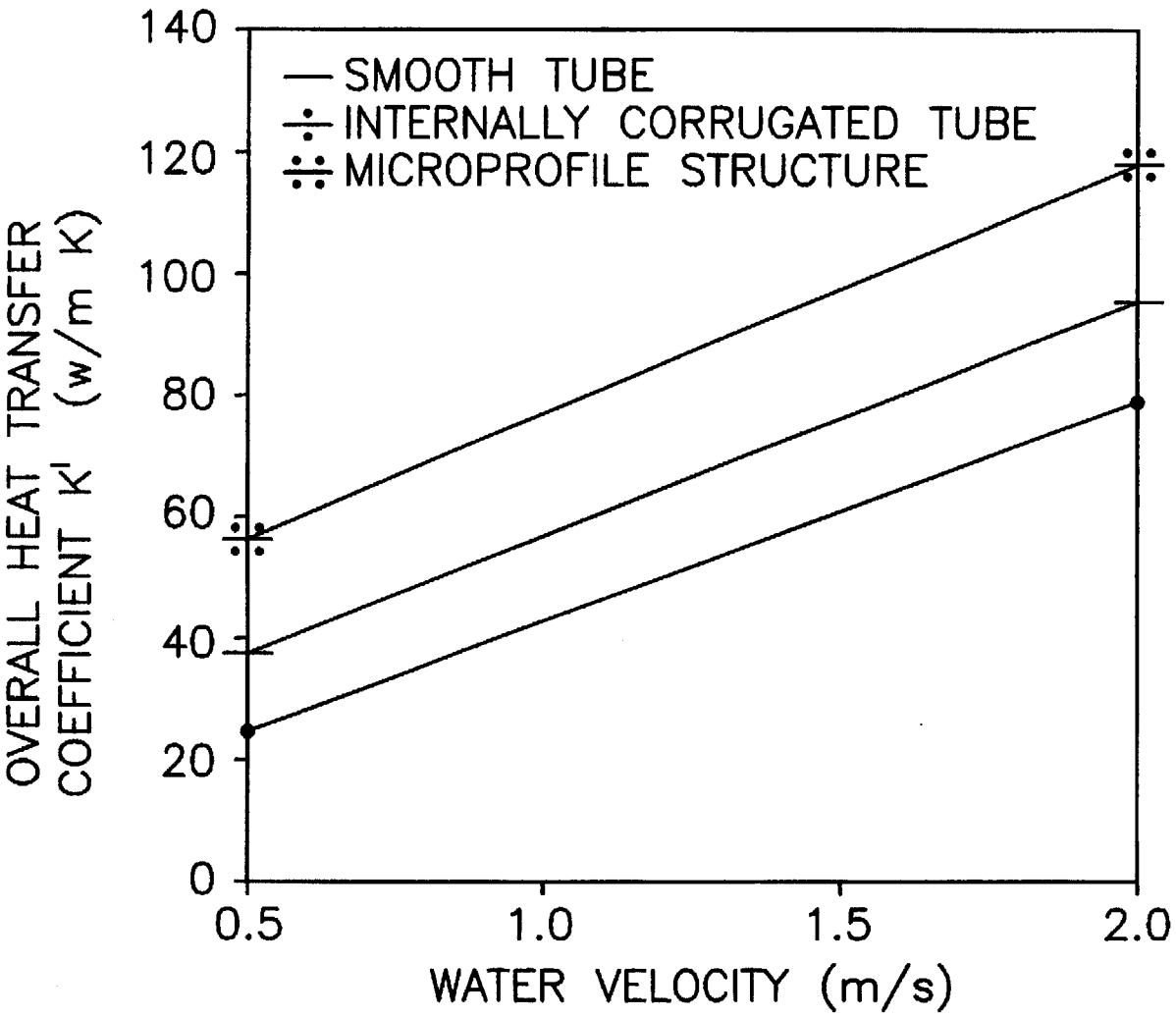

Graphs of data comparing heat exchanger performance for tubes having smooth, corrugated, or microprofiled inner surfaces are presented in FIGS. 6 and 7. The operating conditions under which the data represented in the figures was gathered are as follows:

FIG. 6 (Condensation performance comparisons with respect to a heat exchanger of coaxial construction using different tube designs):

R22 refrigerant

Condensation temperature≈45° C.

Condensate subcooling Δ√u≈5K

Coolant water inlet temperature≈35° C.

Tube Dimensions:

Enclosing tube: 42ϕ×1.5 mm

Inner Tube

Material employed: SF—Cu; 9.52ϕ×0.3 mm

FIG. 7 (Evaporation performance comparisons with respect to a heat exchanger of coaxial construction using different tube designs):

R22 refrigerant in inner tubes

Evaporation temperature≈0° C.

Vapor content at the evaporator inlet x≈0.2

Overheating temperature Δ√u≈4° K.

Heating medium water at inlet temperature≈10° C.

Tube Dimensions:

Enclosing tube: 42ϕ×1.5 mm

Inner Tube

Material employed: SF—Cu; 9.52ϕ×0.3 mm

What is claimed is:

1. A heat exchanger tube for use in a heat exchanger, comprising:

a central longitudinal axis;

a smooth outer surface;

a textured inner surface comprising a plurality of parallel ribs (7) which run at a non-orthogonal angle (α) with respect to the longitudinal axis of the exchanger tube, each rib having a rounded peak, a pair of inclined flanks which form the sides of the ribs, a channel bottom located between adjacent ribs, a pair of rounded transition zones linking the channel bottoms to the adjacent flanks, a progression of depressions and peaks arrayed in sinusoidal form along the ribs, the nearest depressions of adjacent ribs running in a cross-wise direction with respect to the ribs, so that the center longitudinal planes of the depressions run at a non-orthogonal angle (γ) relative to the longitudinal axis of the exchanger tube (1), and wherein the inclined flanks, peaks, and rounded transition zones of the ribs have a micro-roughness.

2. The heat exchanger tube according to claim 1, wherein the center longitudinal planes of the depressions of adjacent ribs are aligned with each other.

3. The heat exchanger tube according to claim 1, wherein the micro-roughness of the rib surfaces is formed by micro-grooves which run parallel to one another and deviate from the longitudinal direction of the ribs.

4. The heat exchanger tube according to claim 2, wherein the micro-roughness of the rib surfaces is formed by micro-grooves which run parallel to one another and deviate from the longitudinal direction of the ribs.

5. The heat exchanger tube according to claim 1, wherein the micro-roughness of the rib surfaces is formed by micro-grooves which intersect in the shape of a cross and deviate from the longitudinal direction of the ribs.

6. The heat exchanger tube according to claim 2, wherein the micro-roughness of the rib surfaces is formed by micro-grooves which intersect in the shape of a cross and deviate from the longitudinal direction of the ribs.

7. The heat exchanger tube according to claim 1, wherein the micro-roughness is produced by particle blasting.

8. The heat exchanger tube according to claim 1, wherein the micro-roughness is produced by particle blasting.

9. The heat exchanger tube according to claim 3, wherein the micro-roughness is produced by laser beams.

10. The heat exchanger tube according to claim 3, wherein the micro-roughness is produced by laser beams.

11. The heat exchanger tube according to claim 1, wherein the depth (T) of the micro-roughness is 0.075 mm or less.

12. The heat exchanger tube according to claim 3, wherein the depth (T) of the micro-roughness is 0.075 mm or less.

13. The heat exchanger tube according to claim 7, wherein the depth (T) of the micro-roughness is 0.075 mm or less.

14. The heat exchanger tube according to claim 9, wherein the depth (T) of the micro-roughness is 0.075 mm or less.

15. The heat exchanger tube according to one of claim 1, wherein the flank angle (β) of the ribs lies in the range of 5° to 60°.

16. The heat exchanger tube according to claim 15, wherein the flank angle (β) of the ribs lies in the range of 10° to 40°.

17. The heat exchanger tube according to claim 1, wherein the longitudinal direction of the ribs runs at an angle (α) of 1° to 89° relative to the longitudinal axis of the exchanger tube.

18. The heat exchanger tube according to claim 17, wherein the longitudinal direction of the ribs runs at an angle (α) of 20° to 55° relative to the longitudinal axis of the exchanger tube.

19. The heat exchanger tube according to claim 1, wherein the angle (δ) defined by the longitudinal direction of the ribs and the center longitudinal planes of the depressions is 90° or less.

20. The heat exchanger tube according to claim 1, wherein the distance between two adjacent ribs is 0.10 mm to 2.0 mm.

21. The heat exchanger tube according to claim 1, wherein the distance between two adjacent ribs is 0.26 mm to 0.6 mm.

22. The heat exchanger tube according to claim 1, wherein the height of the ribs is 0.03 mm to 1.0 mm.

23. The heat exchanger tube according to claim 1, wherein the height of the ribs is preferably 0.05 mm to 0.35 mm.

24. The heat exchanger tube according to claim 1, wherein the distance between two adjacent depressions along a rib is 0.2 mm to 4.0 mm.

25. The heat exchanger tube according to claim 1, wherein the distance between two adjacent depressions along a rib is 0.3 mm to 1.0 mm.

26. The heat exchanger tube according to claim 1, wherein the depression bottoms are arranged at a distance from the channel bottoms.

27. The heat exchanger tube according to claim 1, wherein the depression bottoms are arranged in the same plane as the channel bottoms.

* * * * *